United States Patent [19]

Johnson

[11] Patent Number: 4,506,712

[45] Date of Patent: Mar. 26, 1985

[54] LOG SPLITTING APPARATUS

[76] Inventor: Bruce W. Johnson, Rte. 5, Box 204-I, Raleigh, N.C. 27604

[21] Appl. No.: 540,301

[22] Filed: Oct. 11, 1983

[51] Int. Cl.[3] ..... B27L 7/00

[52] U.S. Cl. ..... 144/193 A; 144/366

[58] Field of Search ..... 144/193 R, 193 A, 193 E, 144/193 K, 366; 254/104

[56] References Cited

U.S. PATENT DOCUMENTS

| | | | |
|---|---|---|---|
| 3,319,675 | 5/1967 | Bles, Sr. | 144/193 A |
| 3,760,854 | 9/1973 | Worthington | 144/193 A |
| 3,938,567 | 2/1976 | Dircksen et al. | 144/193 A |
| 4,103,724 | 8/1978 | Braid | 144/193 A |
| 4,240,476 | 12/1980 | Rattray | 144/193 R |
| 4,275,778 | 6/1981 | Kotas | 144/193 A |
| 4,411,298 | 10/1983 | Ellingsen et al. | 144/193 A |
| 4,454,899 | 6/1984 | Myers, Jr. | 144/193 A |
| 4,458,737 | 7/1984 | Klug | 144/193 K |

*Primary Examiner*—W. D. Bray

*Attorney, Agent, or Firm*—Mills & Coats

[57] ABSTRACT

The present invention relates to a log splitting apparatus that can be mounted to a tractor. The log splitting apparatus of the present invention includes an elongated beam. Secured on one end of the elongated beam is a wedge assembly. Movably mounted on the beam is a log pusher that normally assumes a position spaced from said wedge assembly. The pusher is operatively connected to at least one hydraulic cylinder that is anchored to said beam. To split a log, the log is placed between the log pusher and wedge assembly. After that, the hydraulic cylinder may be actuated causing the pusher to engage and push a log portion into and through said wedge assembly resulting in a log portion being split.

13 Claims, 4 Drawing Figures

LOG SPLITTING APPARATUS

FIELD OF INVENTION

The present invention relates to log splitters and more particularly to log splitters of the general type adapted to be mounted to a tractor or other type of vehicle.

BACKGROUND OF INVENTION

In recent years many families have gone to heating their homes with wood. With the increase use of wood as a fuel source, many different types of log splitters have been developed and commercialized.

But many commercially available log splitters tend to be complicated, expensive and in some cases difficult to use. Other types of log splitters commercially available have not been designed in such a way that they perform reliably, effectively, and efficiently. But perhaps more important is the fact that the more practical and efficient log splitters have only limited utility and can be used for one purpose—that purpose being for log splitting. Because of the cost of a practical and effective log splitter and its limited utility, many people are unable to justify the investment required.

SUMMARY AND OBJECTS OF INVENTION

The present invention relates to a tractor mounted log splitter that also has the capability of pulling or digging up stumps, and can be provided with a detachable tilling implement such as a subsoiler. Also the log splitter of the present invention has been designed with simplicity in mind and in such a way that the same will operate in a dependable and reliable manner.

More particularly, the log splitting apparatus of the present invention is specifically designed to be connected to a tractor or other type of vehicle. As such the same includes an elongated beam that extends from a tractor or vehicle in cantilever fashion. A wedge is secured to the beam and faces a pusher that normally lies in spaced apart relationship to the wedge so as to define a log receiving area therebetween. Hydraulic cylinder means are connected on said beam and to said pusher for driving said pusher towards said wedge. It is thusly appreciated that the pushing of a log into engagement and through the wedge results in the log being splitted into at least two pieces.

It is, therefore, an object of the present invention to provide an improved efficient and effective log splitting apparatus.

Another object of the present invention resides in the provision of a log splitting apparatus that can be easily and conveniently connected to the three-point hitch of a tractor or to some other vehicle such as a front end loader.

Another object of the present invention resides in the provision of a log splitting apparatus that is rugged in design, reliable, dependable and above all economical and practical to both own and operate.

Still a further object of the present invention resides in the provision of a log splitting apparatus that is specifically designed to be used in conjunction with a tractor or other type of vehicle wherein the log splitting apparatus is designed to have other utility besides just splitting logs.

It is also an object of the present invention to provide a log splitting apparatus of the character referred to above that is designed to accept a tilling implement such as a subsoiler and is further operative to transport trees and to be utilized in digging and uprooting stumps and trees.

It is also an object of the present invention to provide a log splitting apparatus of the character referred to above that includes a hydraulic power system that is adapted to be connected to an onboard hydraulic system of a tractor for powering the log splitting apparatus of the present invention.

Another object of the present invention resides in the provision of a log splitting apparatus of the character referred to above that includes a durable and rugged wedge assembly that is designed to withstand the forces and stresses asserted thereagainst by a log during the log splitting operation.

In addition it is a further object of the present invention to provide a log splitting apparatus of the basic character referred to above that is designed to split a plurality of logs simultaneously.

Other objects and advantages of the present invention will become apparent from a study of the following description and the accompanying drawings which are merely illustrative of such invention.

LOG SPLITTING APPARATUS

With further reference to the drawings, the log splitting apparatus of the present invention is shown therein and indicated generally by the numeral 10.

Figure 1:
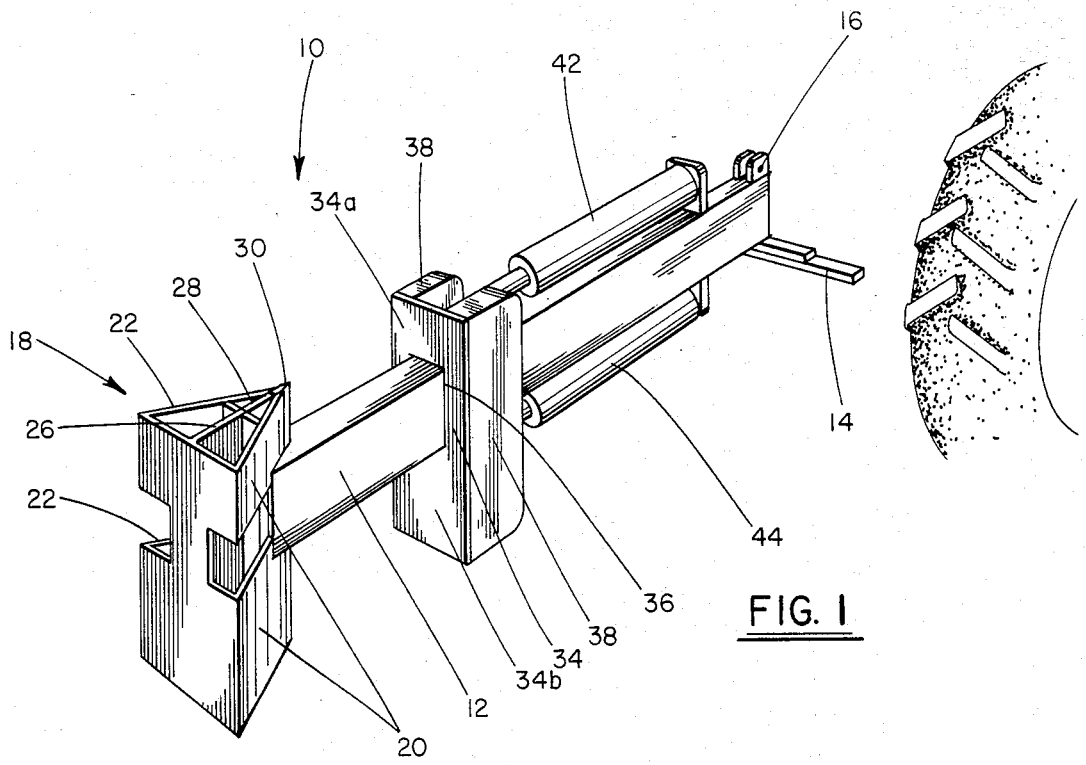
FIG. 1 is a perspective view of the tractor mounted log splitting apparatus of the present invention.
Figure 2:
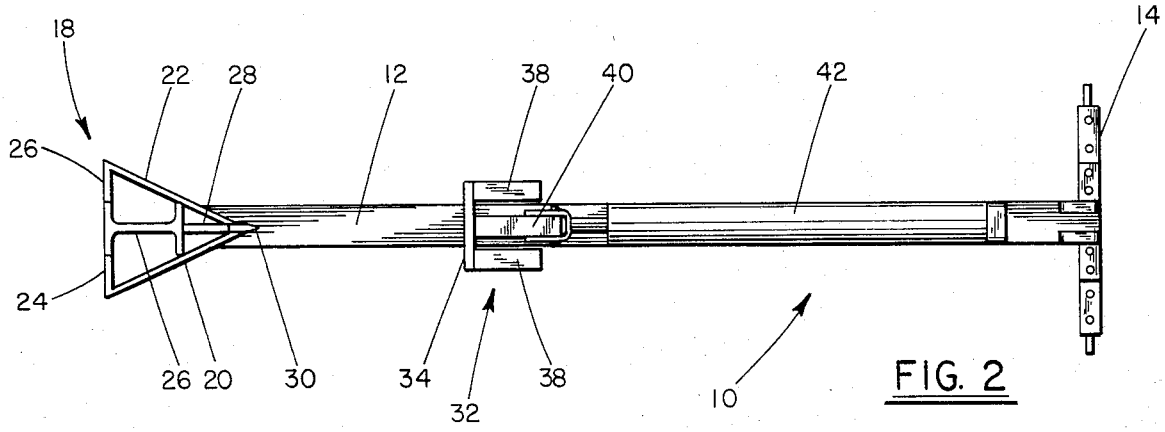
FIG. 2 is a top plan view of the log splitting apparatus of the present invention.

Viewing log splitting apparatus 10 in detail, it is seen that the same includes an elongated box beam 12. Secured about what is referred to as the front end of beam 12 is means for connecting log splitting apparatus 10 to a conventional three-point hitch on a tractor. Particularly, this connecting means comprises a draw bar 14 secured to box beam 12 as illustrated in FIGS. 1 and 2. It is appreciated that draw bar 14 is adapted to be received by the lower draft links of the conventional three-point hitch. Secured about an upper side of the front end of box beam 12 is a clevis 16 that is adapted to connect to the upper draft link of the tractor's three point hitch.

Secured to the rear end portion of box beam 12 is log splitting wedge assembly indicated generally by the numeral 18. Viewing the structure of wedge assembly 18, it is seen that the same includes a pair of spreader plates 20 and 22 that are generally V-shaped as illustrated in FIGS. 1 and 2. Wedge assembly 18 and spreader plates 20 and 22 are formed about the rear end or rear portion of box beam 12 such that a wedge is effectively formed both above and below box beam 12. In subsequent portions of this disclosure, it will be seen that this enables the log splitting apparatus 10 of the present invention to split at least two log sections simultaneously. Continuing to refer to wedge assembly 18, extending inwardly from the rear portions of spreader plates 20 and 22 are back spreader plate extensions 22 and 24 as particularly illustrated in FIG. 2.

To reinforce wedge assembly 18, the same is provided with an elongated I-beam 26 that is secured between spreader plates 20 and 22. I-beam 26 abuts the rear end of box beam 12 and is secured to the sides of plates 20 and 22 by weldment. In addition it is seen that one flange portion of I-beam 26 extends between back spreader plate extensions 24 and 26. This flange portion of I-beam 26 is coupled with back spreader plate extensions 24 and 26 to form the back of wedge assembly 18.

As discussed above, spreader plates 20 and 22 are formed into a V-shaped, as illustrated in FIG. 2, in order to spread oncoming logs moving right to left as viewed in FIG. 2. About the vertex of the formed V, it is seen that the forwardmost portions of spreader plates 20 and 22 are secured and positioned in spaced apart relationship. Secured in the space between spreader plates 20 and 22 about the formed vertex is a wedge 30. It is seen from the drawings that wedge 30 is in the form of a two-piece construction in that one wedge is positioned above box beam 12 while the other is positioned below box beam 12. As particularly illustrated in FIG. 2, there is provided a filler bar 28 interposed between wedge 30 and the forwardmost flange of I-beam 26. The forward projecting wedge 30 includes a beveled edge for first engaging an oncoming log during the log splitting operation. Those skilled in the art will appreciate that the wedge 30 must be of a strong, rugged and durable design.

From reviewing the construction of wedge assembly 18, it is seen that the same is designed for strength, rigidity and durability. The inner reinforcing I-beam 26 maintains spreader plates 20 and 22 in a proper position and orientation for efficiently spreading an oncoming log after wedge 30 has engaged the oncoming end of a particular log.

Movably mounted on box beam 12 is a log pusher indicated generally by the numeral 32. Log pusher 32 includes a front face plate 34 that comprises an upper plate portion 34*a* and a lower plate portion 34*b*. Formed within front face plate 34 is an opening 36 that assumes a shape generally conforming to the shape and area of the cross section of box beam 12. Face plate 34 is threaded onto box beam 12 via opening 36. Secured to each side of face plate 34 is a pair of side panels 38 that project therefrom and extend adjacent the sides of box beam 12. This effectively stabilizes and assists in maintaining alignment of log pusher 32. About upper and lower portions of face plate 34, there is provided a center connecting arm 40 that extends from face plate 34.

Figure 3:
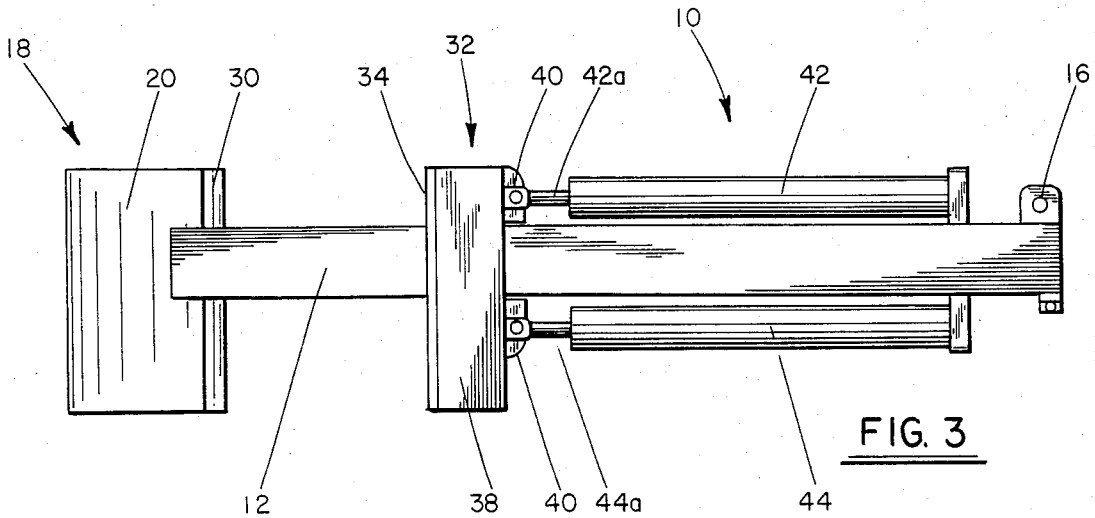
FIG. 3 is a side elevational view of the log splitting apparatus of the present invention.
Figure 4:
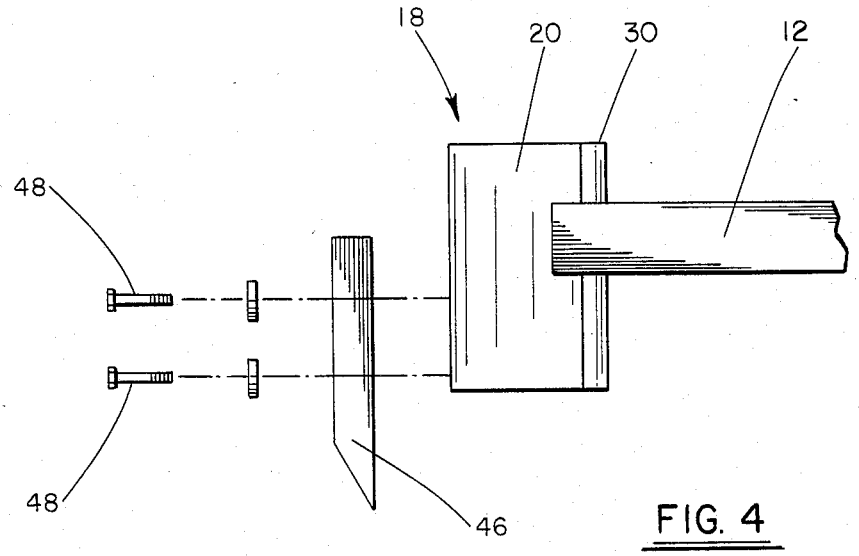
FIG. 4 is a fragmentary side elevational view of the log splitting apparatus of the present invention illustrating a detachable tillage implement that is adapted to be mounted about the rear thereof.

Mounted to box beam 12 about upper and lower sides thereof, forwardly of log pusher 32, is a pair of hydraulic cylinders 42 and 44. As seen in FIG. 3, hydraulic cylinder 42 includes a rod 42*a* that connects to the upper center connecting arm 40, while hydraulic cylinder 44 includes a rod 44*a* that connects to the lower center connecting arm 40.

It is appreciated that hydraulic cylinders 42 and 44 can be operated and actuated in conventional fashion by commercially available hydraulic system component parts. It is contemplated that in use of log splitting apparatus 10 of the present invention with a conventional tractor, that the tractor would have an auxiliary hydraulic control system for powering, actuating and controlling hydraulic cylinders forming a part of implements or attachments that may be connected to the tractor.

It is thusly appreciated that hydraulic cylinders 42 and 44 are operative to move log pusher 32 fore-and-aftly along beam 12. In the position illustrated in the drawings, log pusher 32 assumes a normal retracted position. In that position there is defined an upper and lower log receiving area between the log pusher 32 and wedge assembly 18. It is seen that the log receiving areas extend both above and below beam 12. In operation a log is placed between face plate 34 and wedge 30. A log can be placed either above beam 12 or below beam 12 or in both areas.

The log splitting apparatus 10 of the present invention is designed for additional utility besides simply splitting logs. With reference to FIG. 6, it is illustrated that a tilling implement 46 can be detachably secured to the back side of wedge assembly 18 by bolt assemblies 48. It should be appreciated that tilling implement 46 could be one of several different types of ground engaging implements. It is contemplated that one very useful tilling implement that could be easily and conveniently used with the log splitting apparatus 10 would be a subsoiler.

In operation it is appreciated that a tree trunk or log is first cut into appropriate length sections. These log sections are then placed between log pusher 32 and wedge assembly 18. By actuating hydraulic cylinders 42 and 44, respective log sections are pushed into engagement with wedge 30. The engagement with wedge 30 causes the same to split the oncoming log as the log is pushed towards wedge assembly 18 by log pusher 32. As the log is advanced rearwardly, spreader plates 20 and 22 engage the same and because of the divergence of the spreader plates 20 and 22, the oncoming log section is split and spreaded at the same time. The log pusher 32 continues to move towards wedge assembly 18 until the same reaches a predetermined point at which time the log section has been split. At that time the hydraulic cylinders 42 and 44 return the log pusher 32 back to its retracted position, as shown in FIGS. 1 through 3.

It should also be pointed out that the log splitting apparatus 10 of the present invention can be used in other ways. For example, a fallen tree can be received transversely between the lower portion of pusher 32 and wedge assembly 18. The fallen tree can be picked up from the ground and held such that an individual can cut log sections therefrom. In the same regard, it is seen and appreciated that the log splitting apparatus 10 of the present invention can be used to transport logs and stumps from one location to another.

Further, the log splitting apparatus of the present invention can be utilized to pull small trees from the ground by their roots. To accomplish such, the tree should be pushed over and the splitter should engage and grasp the tree approximately one foot off the ground. Then the tractor is moved causing the log splitting apparatus 10 to pull the tree from the ground. For larger trees, a gripper tooth can be used to break loose the roots around the tree. This enables such trees to be more easily removed.

Briefly referring back to the log splitting apparatus 10, it is preferable that the top portion of wedge assembly 18 be used only on log sections up to eight inches in diameter and on larger pieces that have already been split in half. On very large diameter logs, the lower wedge should be utilized. Preferably the log splitting apparatus should be raised such that only about six inches of the bottom wedge actually engages the log. If the associated hydraulic system cannot generate enough power to completely split the log, then a hand wedge can be driven into the crack formed by the log splitting apparatus and driven to a point that once the hydraulic system is again actuated that the log splitting apparatus will then be able to continue the log splitting operation. It should be pointed out that in some cases as many as three log sections can be split at one time, one log above box beam 12 while two logs can be placed below box beam 12.

From the foregoing discussion, it is appreciated that the present invention presents a very efficient and effective log splitting apparatus that is particularly designed to be mounted to the three-point hitch assembly of a conventional tractor or to a mounting structure associated with some other vehicle such as a skid steer loader. Of particular importance with respect to the present invention is the manner of actually splitting the logs. In this regard the present invention presents a very simple and efficient log splitting arrangement comprised of a log pusher that is hydraulically powered along an elongated beam and wherein the log pusher cooperates with a stationary wedge assembly that is also mounted on beam 12.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended Claims are intended to be embraced therein.

What is claimed is:

1. A tractor mounted log splitting apparatus wherein said log splitting apparatus is adapted to be connected to a three-point hitch assembly of a tractor, said log splitting apparatus comprising: an elongated beam having opposed end; attaching means operatively associated with one end of said beam for connecting said beam to the three-point hitch of said tractor such that when connected said elongated beam extends from said tractor in cantilever fashion; a wedge assembly mounted to said beam and including a log engaging point for engaging the log during the log splitting operation; a log engaging pusher including a log engaging front face means movably mounted for fore-and-aft movement on said beam and normally in an inoperative mode assuming a first position spaced from said wedge assembly so as to define a log receiving area therebetween, said pusher including a log engaging face that faces said wedge assembly and the log engaging point thereof, said log engaging pusher further including an opening extending completely through said front face means and wherein said pusher is mounted on said elongated beam by extending said elongated beam through said opening; and hydraulic cylinder means anchored to said beam and operatively connected to said pusher for moving said pusher from said first position towards said wedge assembly such that a log held and disposed therebetween is split by the action of said pusher means driving said log into and through said wedge assembly, said hydraulic cylinder means further being operative to return said pusher back to said first position.

2. The log splitting apparatus of claim 1 wherein said pusher extends both above and below said elongated beam and includes an upper pusher face and a lower pusher face, and wherein said wedge assembly extends both above and below said elongated beam and includes an upper log engaging point and a lower log engaging point; and wherein said pusher and said wedge assembly defines upper and lower log receiving areas such that two log portions may be split simultaneously by the pushing action of said pusher engaging and urging two separate log portions into engagement with said wedge assembly.

3. The log splitting apparatus of claim 2 wherein said hydraulic means includes first and second hydraulic cylinders disposed on opposite sides of said elongated beam and wherein each of said hydraulic cylinders are connected to said pusher for simultaneously driving the same when said log splitting apparatus is actuated to split a log.

4. The log splitting apparatus of claim 1 wherein said wedge assembly further includes a pair of spreader plates that extend from and flare outwardly from said engaging point to form a generally V-shaped wedge wherein said flared spreader plates generally act to spread a respective log during the log splitting operation.

5. The log splitting apparatus of claim 4 wherein said wedge assembly further includes an elongated beam that extends generally between said spreader plates so as to reinforce the wedge assembly structure.

6. The log splitting apparatus of claim 5 wherein said beam extending generally between said flared spreader plates of said wedge assembly includes an I-beam and wherein said I-beam includes a flange side that forms a portion of the rear portion of said wedge assembly.

7. The log splitting apparatus of claim 1 wherein said wedge assembly includes a generally V-shaped wedge structure having a vertex area including a pair of sides that extend outwardly from said vertex area to form a generally V-shaped wedge structure wherein said generally V-shaped wedge structure includes a wedge that extends between said sides and outwardly from said V-shaped wedge structure through the vertex and wherein said wedge includes an outer beveled log engaging edge.

8. The log splitting apparatus of claim 1 further including a detachable tillage implement adapted to be connected to said log splitting apparatus; and means for detachably connecting said tillage implement to said log splitting apparatus.

9. The log splitting apparatus of claim 8 wherein said detachable tillage implement is a subsoiler.

10. The log splitting apparatus of claim 1 wherein said elongated beam is a box beam.

11. A log splitting apparatus comprising: a support structure; an elongated beam having upper and lower sides and opposed ends; attaching means operatively associated with one end of said beam for connecting said beam to said support structure such that when connected said elongated beam extends from said support structure in cantilever fashion; a wedge assembly disposed on the lower side of said beam and including a log engaging point for engaging the log during the log splitting operation; a log engaging pusher movably mounted for fore-and-aft movement on said beam and including a log engaging face disposed on the lower side beam and which projects downwardly therefrom where said log engaging face is disposed in a normal first position opposite said wedge assembly and spaced therefrom so as to define a log receiving area underneath said beam; said log engaging pusher further including an opening extending completely through said face and wherein said pusher is mounted on said elongated beam by extending said elongated beam through said opening; and hydraulic cylinder means anchored to said beam and operatively connected to said pusher for moving said log engaging face from said first position towards said wedge assembly such that a log held and disposed therebetween is split by the action of said pusher means driving said log into and through said wedge assembly, said hydraulic cylinder means further being operative to return said pusher back to said first position, whereby a log may be picked-up and held transversely underneath said beam and between said pusher and said wedge, so that sections maybe cut therefrom, and further wherein a log maybe held longitudinally between said pusher and said wedge for splitting.

12. The log splitting apparatus of claim 11 wherein the same is adapted to be connected to the three-point hitch assembly of a tractor wherein said attaching means includes means for attaching one end of said beam to said three-point hitch assembly of the tractor.

13. The log splitting apparatus of claim 12 further including a tillage implement secured to said log splitting apparatus and extending downwardly therefrom such that the same can be used as a tillage implement such as a sub-soiler.

* * * * *